United States Patent [19]

Sasaki et al.

[11] 4,224,789

[45] Sep. 30, 1980

[54] ELECTRONIC TIMEPIECE

[75] Inventors: Seiko Sasaki; Kazuhiro Asano, both of Tokyo, Japan

[73] Assignee: Kabushiki Kaisha Daini Seikosha, Tokyo, Japan

[21] Appl. No.: 906,562

[22] Filed: May 16, 1978

[30] Foreign Application Priority Data

May 20, 1977 [JP] Japan ..... 52-58387

[51] Int. Cl.[2] ..... G04B 19/24; G04B 27/00

[52] U.S. Cl. ..... 368/185; 368/28

[58] Field of Search ..... 58/4 A, 23 R, 38, 39, 58/39.5, 50 R, 57, 57.5, 58, 152 R, 152 B, 85.5; 235/92 T; 307/220 C, 221 C; 324/186; 364/705

[56] References Cited

U.S. PATENT DOCUMENTS

| | | | |
|---|---|---|---|
| 3,803,834 | 4/1974 | Reese | 58/50 R |
| 3,854,277 | 12/1974 | Samejima et al. | 58/152 R |
| 3,940,920 | 3/1976 | Nakamura et al. | 58/50 R |
| 3,955,355 | 5/1976 | Luce | 58/50 R |
| 4,063,409 | 12/1977 | Bayliss | 58/4 A |
| 4,109,315 | 8/1978 | Pan | 58/152 R |
| 4,132,060 | 1/1979 | Kashio | 58/85.5 |

*Primary Examiner*—Edith S. Jackmon

*Attorney, Agent, or Firm*—Robert E. Burns; Emmanuel J. Lobato; Bruce L. Adams

[57] ABSTRACT

An electronic timepiece circuit including a data memory for storing time information and display information, and an operating circuit which renews the data stored in the data memory circuit. A program memory circuit stores a sequential program for determining generation of control signals supplied to the data memory circuit and the operating circuit. Two different command data systems are stored in the program memory circuit. One command data system consists of controlling commands which carry out time counting, time setting and display functions, and for pointing addresses in the data memory circuit. The other command data system consists of commands for judging conditions, for pointing addresses of the data memory and for pointing the jump address of the programs stored in the program memory circuit.

3 Claims, 11 Drawing Figures

ELECTRONIC TIMEPIECE

BACKGROUND OF THE INVENTION

The present invention relates to an electronic timepiece, and especially relates to a construction of an instruction code which is memorized to a program memory, and further relates to a programming function of an electronic timepiece.

In the conventional type electronic timepiece there are different ways for counting time, i.e. the second and minute figures are displayed by a 60-counting mode, the hour figure is displayed by a 12 or 24 counting mode, the day of a week is displayed by a 7 counting mode, and the date is displayed by a 28–31 counting mode.

Further, in case of a carry, as when the last digit one figure changes from "9" to "0", from "2" to "1", from "7" to "1" and from "0" to "1", setting or resetting after detection of the carry by a gate means has been required.

SUMMARY OF THE INVENTION

According to the present invention, ROM (Read Only Memory) i.e. it is called RAM (Random Access Memory) system which operates the same as a computer is provided. Therefore, necessary information is called from the RAM and is directed to an accumulator and is operated in an operational portion, and an output of the operational portion is applied to the accumulator and the RAM. Therefore it is necessary to provide a transfer and operation respectively.

The above noted function is attained by adding an application of a computor function. It is preferable to count a time by only operational instruction without a transfer instruction from the stand point of a data processing means, a reduction of a processing time and a reduction of RAM capacity.

The present invention aims to obtain an electronic timepiece of a digital type with ROM or RAM.

EXPLANATION OF THE DRAWINGS

FIG. 4(*b*) shows a wave shape of FIG. 4(*a*),

DESCRIPTION OF THE PREFERRED EMBODIMENT

Figure 1:
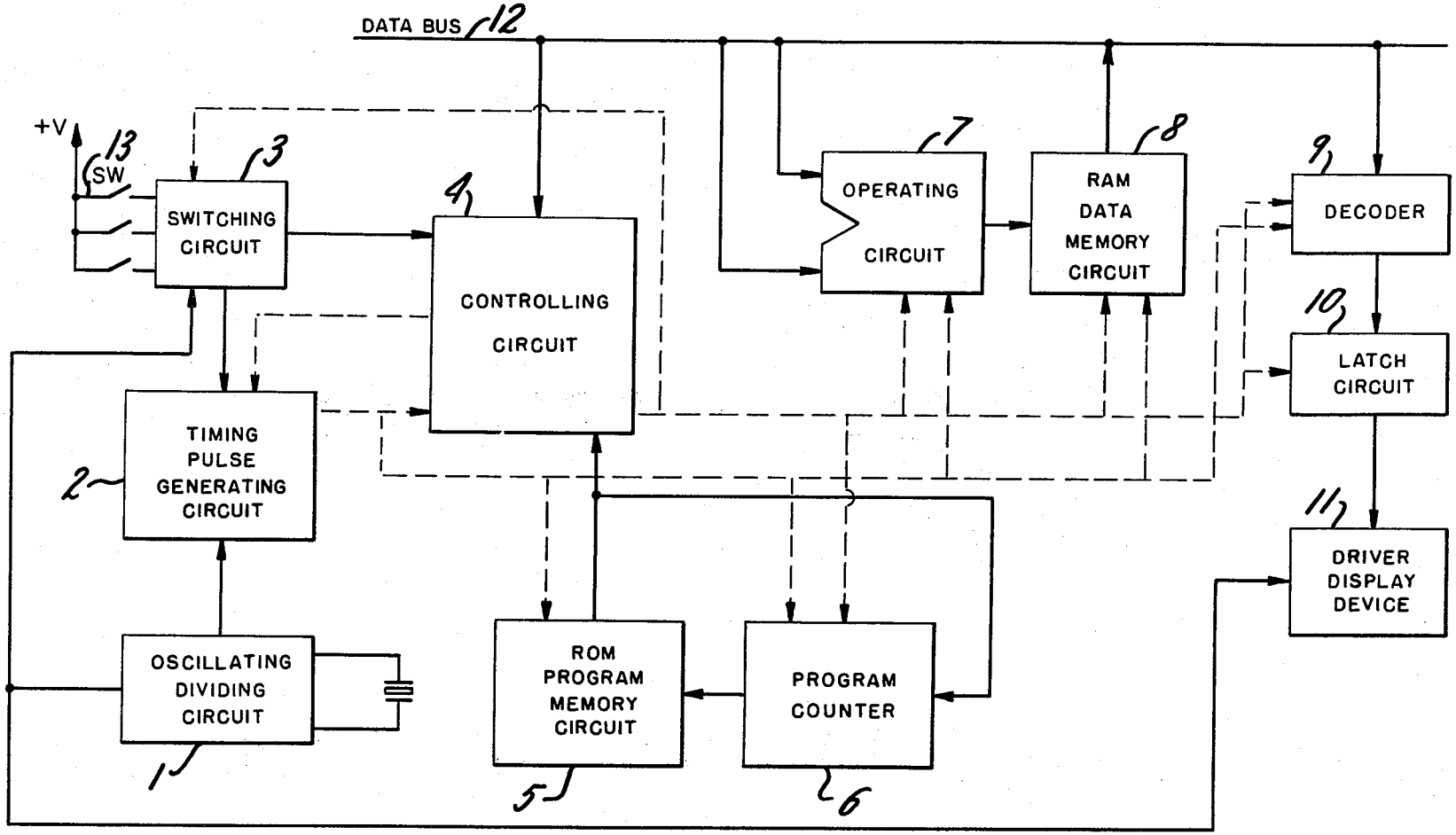
FIG. 1 shows a block diagram of one embodiment of the present invention.

Referring now to a preferred embodiment of the present invention, illustrated in the accompanying drawings in which:

FIG. 1 shows a block diagram for indicating the entire structure of an electronic timepiece of the present invention, wherein numeral 1 is an oscillating and dividing circuit, and a dividing circuit output signal is applied to a timing pulse generating circuit 2, a switching circuit 3 and a driving circuit 11.

Said timing pulse generating circuit 2 generates a timing pulse by receiving a signal from the oscillating dividing circuit 1, switching circuit 3 and controlling circuit 4. The timing pulse developed by the timing pulse generating circuit is applied to a controlling circuit 4, a program memory circuit 5, a program counter 6, an operating circuit 7, a data memory circuit 8 and a decoder 9.

The switching circuit 3 receives a signal of a switch 13 in which one terminal is connected to a high voltage point, a control signal from said controlling circuit 4 and a clock signal from said dividing circuit 1. A switching signal of the switch 13 is shaped to a preferable switching signal by the switching circuit 3, and is applied to said controlling circuit 4.

The controlling circuit 4 receives the signals from the program memory circuit 5, a data bus 12, the switching circuit 3 and the timing pulse generating circuit 2, and is applied to said switching circuit 3, said timing pulse generating circuit 2, said operating circuit 7, said data memory circuit 8, said decoder 9, a latch circuit 10 and said program counter 6.

On the other hand, said program counter 6 receives a present address signal from said program memory 5 and a jump control signal from said controlling circuit 4, and generates a next address signal to said program memory circuit 5.

Said operating circuit 7 operates on a data signal from said data bus 12 according to an operating command signal from said controlling circuit 4, and generates and applies results of said operation to said data memory circuit 8.

Said data memory circuit 8 receives a control signal from said controlling circuit 4, and generates and applies data to said data bus 12.

Said decoder 9 decodes data on said data bus 12 in response to a signal from said controlling circuit 4, and transfers an output to said latch circuit 10.

Said latch circuit 10 reads a decoded signal in synchronized to a signal from said controlling circuit 4, and generates a signal which is applied to a driving circuit 11.

Referring now to an operation of the present invention:

A program for executing a count and display is memorized to said program memory circuit 5.

If a one second pulse signal is generated from said oscillating dividing circuit 1, said timing pulse generating circuit 2 receives said one second pulse signal and generates a timing pulse signal.

Said program memory circuit 5 is started by said timing pulse signal, and generates program data applied to said controlling circuit 4 according to an address which is designated by said program counter 6.

Said controlling circuit 4 reads a signal from said program memory circuit 5 and generates the control signals for each section.

For instance, a seconds figure information in time information which is stored to said data memory circuit 8 is applied to said data bus 12 and executes an adding command "ADD" applied to said operating circuit 7 and adds "1" to a seconds figure signal. Further a discrimination of a carry is executed, and data is maintained in the latch circuit 10 via the decoder 9.

These above noted operations are executed by sequentially executing a program which is memorized in said program memory circuit 5.

Finally a stop command "HLT" is generated from said program memory circuit after completely finishing all necessary operations, and said command "HLT" is applied to the timing pulse generating circuit 2 via said controlling circuit 4.

The timing pulse generating circuit 2 receives a signal and stops generating a timing pulse signal.

At this time, the program counter 6 is simultaneously reset and is maintained so as to start an operation from a "0" address in next time.

When one second signal is generated from the oscillating dividing circuit 1 and a switching signal "SWFLG" is applied to the timing pulse generating circuit 2 by switching the switch 13, an operation is executed by a program of the program memory circuit 5.

Figure 2:
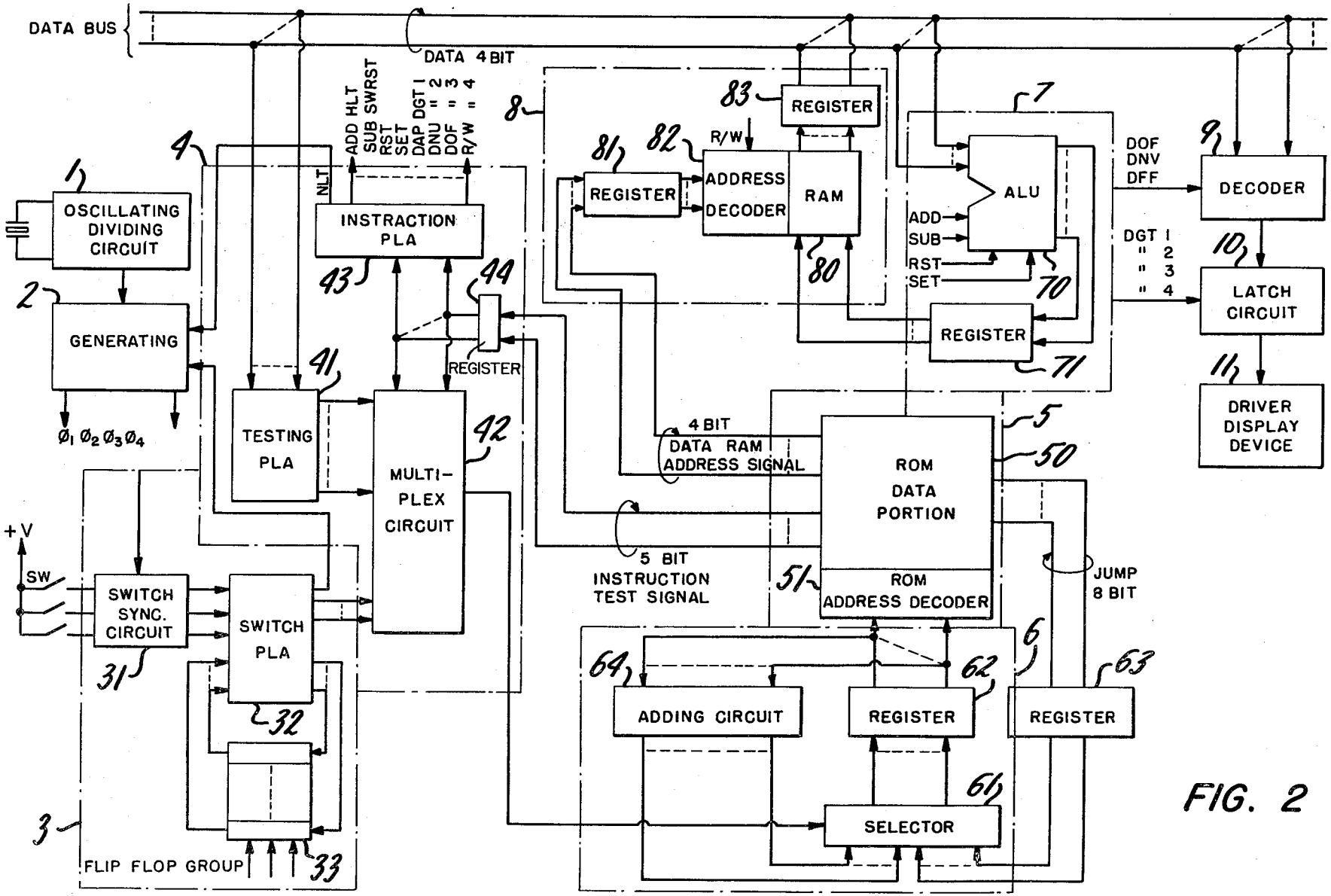
FIG. 2 shows a detailed embodiment of FIG. 1.

Further referring now to a detailed construction of the present invention:

FIG. 2 shows a block diagram of the present invention, wherein a switch synchronizing circuit 31 is connected to an outer switch, an output of said switch is connected to one part of an input of a switch PLA (Programmable Logic Array) 32. An output of one part of said switch-PLA 32 is applied to a flipflop group 33, an output of said flip flop group 33 is connected to another input terminal of said switch-PLA 32. Another output terminal of said switch-PLA 32 is applied to one input terminal of a multi-plex circuit 42 and the timing pulse generating circuit 2. The data bus 12 is connected to an input of a test-PLA 41. An output of said test-PLA 41 is applied to another input terminal of said multi-plex circuit 42. An output of the program memory circuit 5 is applied to another input terminal of said multi-plex circuit 42 via a register 44.

An output of said multi-plex circuit 42 is applied to a control terminal of a selector 61. An output of the program memory 5 is applied to an instruction-PLA 43, each of the output terminals are applied to the timing pulse generating circuit 2, the switch circuit 3, the program counter 6, the operation circuit 7, the data memory circuit 8, the decoder 9 and the latch circuit 10.

An output of said program memory 5 is applied to one input terminal of the selector 61 via a register 63, an output of adding circuit 64 is applied to an another input terminal of said selector 61. An output of said selector 61 is applied to a register 62.

An output of said register 62 is applied to a ROM address decoder 51, and is applied to the adding circuit 64. The program memory circuit 5 is composed of a ROM 50 and a ROM address 51. An operating circuit 7 is composed of ALU 70 (arithmetic logic unit) and a register 71, a data bus is connected to one input terminal of said ALU 70, and a control signal from an instruction PLA 43 is applied to an another input terminal of said ALU 70.

An output of said ALU 70 is applied to a register 71, an output of said register 71 is applied to a RAM 80 of a data memory circuit 8. An output of a ROM 50 is applied to a register 81, an output of said register 81 is applied to a RAM address decoder 82. On the contrary, an output terminal of a RAM 80 is connected to a register 83, an output terminal of said register 83 is connected to a data bus 12.

Referring now to operation of the present invention illustrated in the accompanying drawing FIG. 2:

Information for designating an address of a ROM 50 is memorized in a register 62 in the program counter 6. Said register 62 is composed of 8 bits, an output of said register 62 is applied to a ROM address decoder 51. A contents of 8 bits of said register 52 is decoded to a signal for designating a certain ROM address by a ROM address decoder 51. In this case, it is able to provide with a number of methods of $2^8=256$ as a signal for designating ROM address, a maximum number of program steps in this embodiment becomes 256, a number of program steps for executing an operation, a correction and a display should be set to 256.

The contents of ROM 50 which was selected by a signal from a ROM address decoder 51 is generated and applied outside of a ROM, a part of said contents is applied to a multi-plex circuit 42 and an instruction PLA 43, an another part of said contents is applied to a register 81, and another part of said contents is applied to a register 63. At this time data of a RAM 80, namely a time information of 4-bits, is applied to a multi-plex circuit 42 via a test-PLA 41 of a data-bus. A signal from a switch PLA 32 is applied to said multi-plex circuit 42.

A data construction of ROM 50 is composed of two forms of format I (10-bits) and format II (18-bits) as follows:

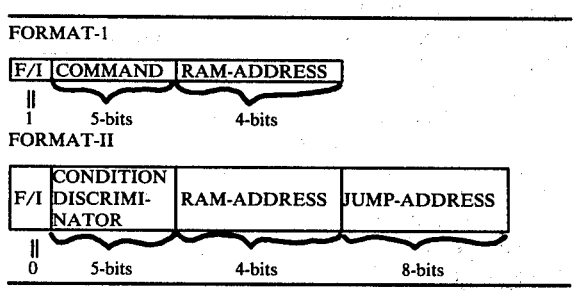

Format I is composed of a memory circuit having a control command (5-bits) and RAM-address (4-bits) for executing a time count, correction and display. Further Format II is composed of a memory circuit having condition discriminator (5-bits), RAM-address (4-bits) and jump address (8-bits). When F/I bit is "0", Format becomes to Format-1. When F/I bit is "1", Format becomes Format-II.

Referring now to a detailed part of Formats-1 and II accompanying the tables:

Table-1 shows RAM-address data, a name of a register which memorizing time information and other information corresponding to each of addresses.

For example, an address [0110] is a register [10H] for storing time information of 10 hours figure, further an address [1110] is a register [C] for memorizing and counting 2 seconds which is a command display time.

TABLE 1

(RAM data arrangement)

| ADDRESS | REGISTER NAME | CONTENTS OF REGISTER |
|---|---|---|
| 0000 | — | — |
| 0001 | S | Time Memory of 1 second fig |
| 0010 | 10S | Time Memory of 10 seconds fig |
| 0011 | m | Time Memory of 1 minute fig |
| 0100 | 10m | Time Memory of 10 minutes fig |
| 0101 | H | Time Memory of 1 hour fig |
| 0110 | 10H | Time Memory of 10 hours fig |
| 0111 | AP | Memory of AM and PM |
| 1000 | D | Time Memory of 1 day fig |
| 1001 | 10D | Time Memory of 10 days fig |

TABLE 1-continued (RAM data arrangement)

| ADDRESS | REGISTER NAME | CONTENTS OF REGISTER |
|---|---|---|
| 1010 | M | Time Memory of 1 month fig |
| 1011 | 10M | Time Memory of 10 months fig |
| 1100 | F | Select Register |
| 1101 | E | Command Flag |
| 1110 | C | Register for counting 2 seconds |
| 1111 | Z | Register for set |

Table-II shows a code arrangement of a command, and is composed of 5-bit combinations, and is able to generate a command of $2^5$. For example, code (00100) adds [1] to a data in a RAM80 of RAM-address 82 which was designated by a command ⌈ADD⌋, and writes a result in to RAM80 which was designated by said RAM address 82. Similarly, code [110xx] controls a decoder by a command ⌈DAP⌋, whereby a AP display (AM or PM) is displayed. Further code [1xx00] latches data to a first display figure by a command ⌈DGT⌋.

TABLE II

Command code arrangement

| CODE | COMMAND | ACTION | |
|---|---|---|---|
| 000 00 | NOP | NO OPERATION | |
| 001 00 | ADD | [D] ← [D] + 1 | ALU CONTROL |
| 010 00 | RST | [D] ← [0000] | ALU CONTROL |
| 011 00 | SET | [D] ← [0001] | ALU CONTROL |
| 001 01 | SUB | [D] ← [D] − 1 | ALU CONTROL |
| 001 10 | SWRST | SW FLAG RESET | |
| 111 11 | HLT | CLOCK STOP | |
| 100 xx | DNU | DISPLAY | DECODER CONTROL |
| 101 xx | DOF | DISPLAY OFF | DECODER CONTROL |
| 110 xx | DAP | DISPLAY AP | DECODER CONTROL |
| 1xx 00 | DGT1 | FIRST FIG LATCH | |
| 1xx 01 | DGT2 | SECOND FIG LATCH | LATCH CONTROL |
| 1xx 10 | DGT3 | THIRD FIG LATCH | LATCH CONTROL |
| 1xx 11 | DGT4 | FOURTH FIG LATCH | LATCH CONTROL |

Therefore, according to an information of command 5-bits of Format-1, an operation, correction and display of a time information are executed by the control signals.

Table-3 shows a code arrangement of a condition discriminator which is composed of 5-bits, and generates the signals for discriminating among many conditions.

In case of a normal time count, an operated time and a present time are necessarily compared to execute a carry, set and reset, and data for executing the above noted comparison is applied thereto. Further a set, reset or switch of a display are necessarily executed by information from an outer switch, and data for executing the above operation is applied thereto.

TABLE-3

(a code in a condition discriminator)

| CODE | CONDITION | CODE | CONDITION | CODE | CONDITION |
|---|---|---|---|---|---|
| 00000 | 1 | 01010 | INC3 | 10100 | =2 |
| 00001 | ϕ | 01011 | INC4 | 10101 | ≠2 |
| 00010 | ST | 01100 | SWFLG | 10110 | ≠3 |
| 00011 | SRST | 01101 | | 10111 | =3 |
| 00100 | INC | 11110 | ≠4,6,9 | 11000 | =4 |
| 00101 | FNC | 11111 | =15 | 11001 | ≠4 |
| 00110 | COM | 10000 | =0 | 11010 | =6 |
| 00111 | SRST | 10001 | ≠0 | 11011 | =8 |
| 01000 | INC1 | 10010 | =1 | 11100 | =10 |
| 01001 | INC2 | 10011 | ≠1 | 11101 | ≧3 |

A jump address (8-bits) of Format II compares a content of a condition discriminator (5-bits) and contents being applied to a multi-plex circuit 42, it jumps to address when a compared results is ⌈No⌋ or ⌈lie⌋.

Referring now to Format-I and Format-II for describing the operation in detail.

In the case of Format-I, One output of ROM50 namely RAM address (4-bits) is applied to a register 81 (4-bits), another output of ROM50 namely a command (5-bits) is only applied to an instruction PLA43 via a register 44 since F/I is ⌈1⌋.

Data of 4-bits which was applied to a register 81 is applied to a RAM address decoder 82, and selects a certain RAM address, and reads data which is memorized in a RAM80, and applies said data to a data-bus 12.

Data of 5-bits which was applied to an instruction PLA43 is translated and read by said instruction PLA43, and controls an action of RAM80 and ALU70, and executes a transference and operation of time data information. For example, in the case of the outputs [$D_0$, $D_1$, $D_2$, $D_3$, $D_4$, $D_5$, $D_6$, $D_7$, $D_8$ and $D_9$] of ROM data being [1001000001], $D_0$=F/I, $D_1$–$D_5$=command, $D_6$–$D_9$=RAM address. A command ⌈ADD⌋ is generated from said TABLE-2 since $D_0$=1 and $D_1$–$D_5$=[00100] in Format I, and a time memory of one second figure is indicated in a register ⌈S⌋ according to Table-1 since $D_6$–$D_9$ is [0001].

Therefore, data of 10-bits which was generated from a ROM50 applies data of a register ⌈S⌋ of ROM80 to a data-bus 12 via a register 83. [1] is added to data on said data-bus by a control signal which was translated and decoded to a command [ADD] from said instruction PLA43, and added results are stored to a register ⌈S⌋ of RAM80 via a register 71.

At this time, read and store commands of data of RAM80 are generated from an instruction PLA43 accompanying said command ⌈ADD⌋, and is applied to a data memory 8 and controls said data memory.

In case of Format II, Another output of (8-bits) is applied to selector 61 via a register 63.

In this case, data of a condition discriminator of 5-bits is only applied to a multi-plex circuit 42 since F/I is "0". A data of 4-bits which was applied to a register 81 is applied to a RAM address decoder 82, and selects a certain RAM address, and reads a data which is memorized in RAM80, and applies said data to a data-bus. Data of 5-bits of a condition discriminator is applied to a multi-plex circuit 42 via a register 44, and selectively generates an output after selected on output from a test PLA 41 which is applied to a multi-plex circuit 42 and an output from a switch PLA 32. An output signal is applied to a selector 61, and controls a selection of the output signals of adding circuit 64 and register 63.

When a signal of a switch PLA 32 or a test PLA 41 and a test signal from ROM respectively coincide, a next executing ROM address adds "1" to an executing ROM address, and selects an output from an adding circuit 64 so as to be set to a register 62 as a next executing ROM address.

On the contrary, when a signal of a test PLA 41 or a switch PLA 32 and a test signal from ROM do not coincide, an information of a register 63 in which data of 8-bits of a jump address is applied thereinto is selected to that a next executing ROM address is able to jump from an executing ROM address, and sets to a register 62.

For example, in case of the outputs of ROM-data [$D_0$, $D_1$, $D_2$, $D_2$, $D_2$, $D_4$, $D_5$, $D_6$, $D_7$, $D_8$, $D_9$, $D_{10}$, $D_{11}$, $D_{12}$, $D_{13}$, $D_{14}$, $D_{15}$, $D_{16}$ and $D_{17}$] are [01111111101-0000000], $D_0$ is F/I, $D_1$–$D_5$ are a condition discriminator, $D_6$–$D_9$ are RAM address, $D_{10}$–$D_{17}$ are jump address.

Further $D_0=0$ since in Format II, a condition=15 is obtained from TABLE-3 since $D_1$–$D_5$ are [11111], 2-seconds counting register is indicated in a register "C" since $D_6$–$D_9$ are [1110], an address "80" (shown in 16-counting) is indicated since $D_{10}$–$D_{17}$ are [10000000]. If an executing ROM address is "40" (shown in 16 counting), a jumping address indicates an address "80".

Data of a register "C" of RAM-80 is applied to a data-bus 12 via a register 83 since a signal of RAM address of ROM output is [1110], said data is applied to a test PLA 41, an output of said test PLA 41 is applied to a multi-plex circuit 42. Data of a condition discriminator is applied to a multi-plex circuit 42 via a register 44. Further data of a jump address is applied to a selector 61 via a register 63. Data of an address "40" which is an executing ROM address is set to a register 63, an adding circuit 64 generates "41" is added to a present address, and is applied to a selector 61.

Therefore, when a data on a data-bus 12, namely contents of a register "C", and contents of a condition discriminator of ROM namely [=15] coincide, a plus 1 address "41", namely an output of an adding circuit 64 passes a selector 61 and is set to a register 62. In the next executing cycle, a program proceeds according to contents which is memorized to an address 41. When a contents of register "C" and contents of a condition discriminator do not coincide, a jumping address "80" which is set to a register 63 passes a selector 61 and is set to a register 62, and a program proceeds according to contents which is memorized to an address "80" in a next executing cycle.

If an output of a multi-plex circuit 42 is H-level according to the operation and structure of ROM, jump address is selected. Further, if an output of a multi-plex circuit 43 is L-level, a plus 1 address is selected, whereby a program which is memorized in ROM50 is sequentially executed, therefore, an operation, correction and display of a time are executed.

Referring now to a display of the present invention:

In this case, data for a display should be located on a data-bus 12, therefore, a construction of ROM employs a form of Format I. A presence of a display and a display's figure are designated according to a combination of a decoder control command and a latch control command.

When a Format I is [1100100101], $D_0$ is [1] according to a Format-I, $D_1$–$D_5$ are [10010], namely $D_1$–$D_3$ has a command [DNU] for displaying a RAM data, $D_4$–$D_5$ has a command [DGT3] for latching data to a display figure.

$D_6$–$D_9$ displays a RAM address [H] by [0101] and displays a time memory of 1 hour figure.

Therefore, said ROM-data designates a RAM-address [H] and applies a contents of [H] to a data-bus 12 via a register 83 and applies to a decoder 9. At this time, simultaneously a latch command and a display command are generated, time information namely 1 hour figure which was applied to a decoder 9 is decoded to a display segment signal by said decoder 9 according to a display command, and is applied to a latch circuit 10.

A display data which is applied to a latch circuit 10 is latched to a memory circuit which corresponding to a 1-hour figure namely 5-bits 3 according to a latch command. A latched display data is applied to a driver display device 11 whereby certain time information is displayed.

A time correction and a display selection are executed by an operation of an outer switch. Namely, in response to ON or OFF of a switch, an electric signal including a chattering signal is applied to a switch synchronizing circuit 31. Said switch synchronizing circuit 31 eliminates a chattering, switching signal is synchronized by a certain frequency, and said switching signal is generated during an executing cycle time of all program. An output signal from said switch synchronizing circuit 31 is applied to a switch PLA 32, and is changed to a certain signal, a part of said output signal is applied to a multi-plex circuit 42, another part of said output signal is applied to a flip flop group 33 for memorizing a present information, and an output of said flip flop group 33 is returned to said switch PLA 32.

An output from said switch PLA 32 is generated as follows:

| | |
|---|---|
| FNC | signal for selecting a correction figure in correcting operation |
| INC | time correcting signal |
| COM | display selecting signal |
| SRST | second reset signal |

These switching signals are compared with a condition discriminating data which was generated from ROM50 by a multi-plex circuit 42 whereby said these switching signals become data (information) for discriminating the condition of a jump of a next executing address of ROM or a plus 1 address.

Figure 3:
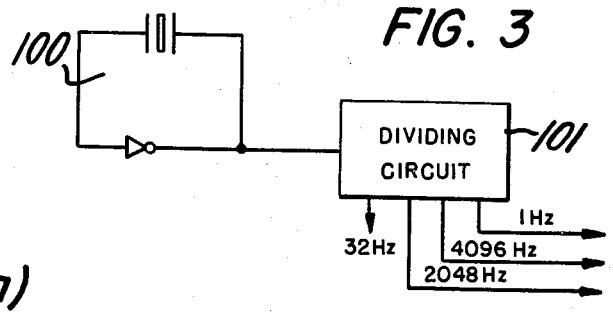
FIG. 3 shows an oscillating and dividing circuit construction.
Figure 4A:
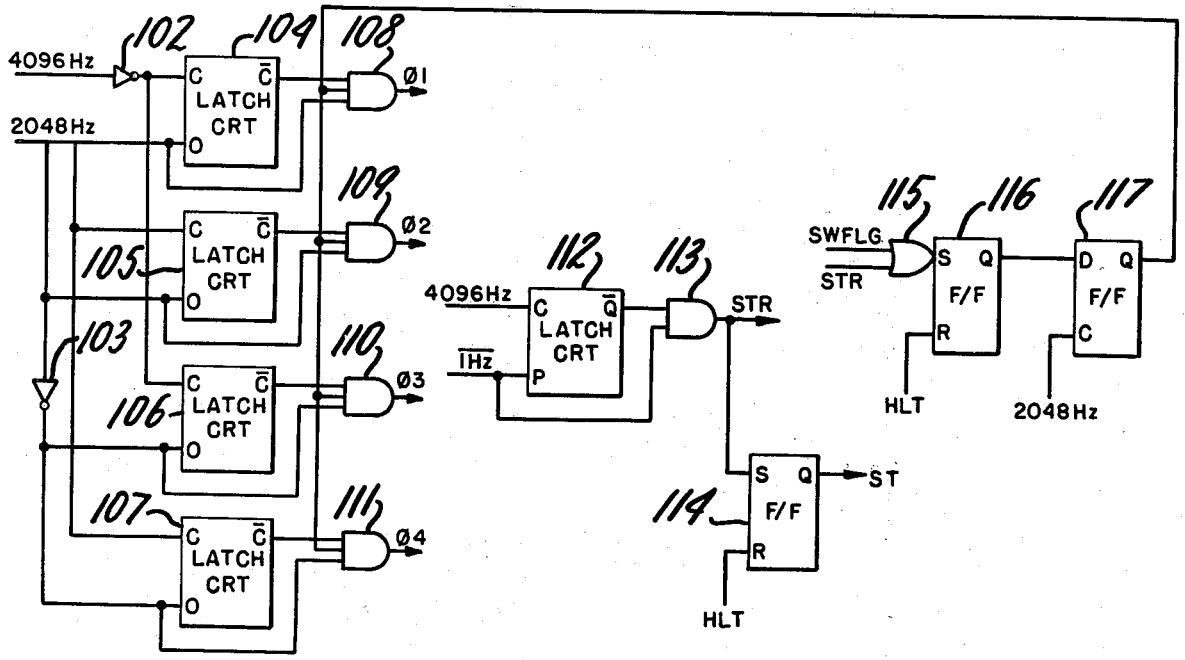
FIG. 4(*a*) shows a timing pulse generating circuit construction.
Figure 4B:
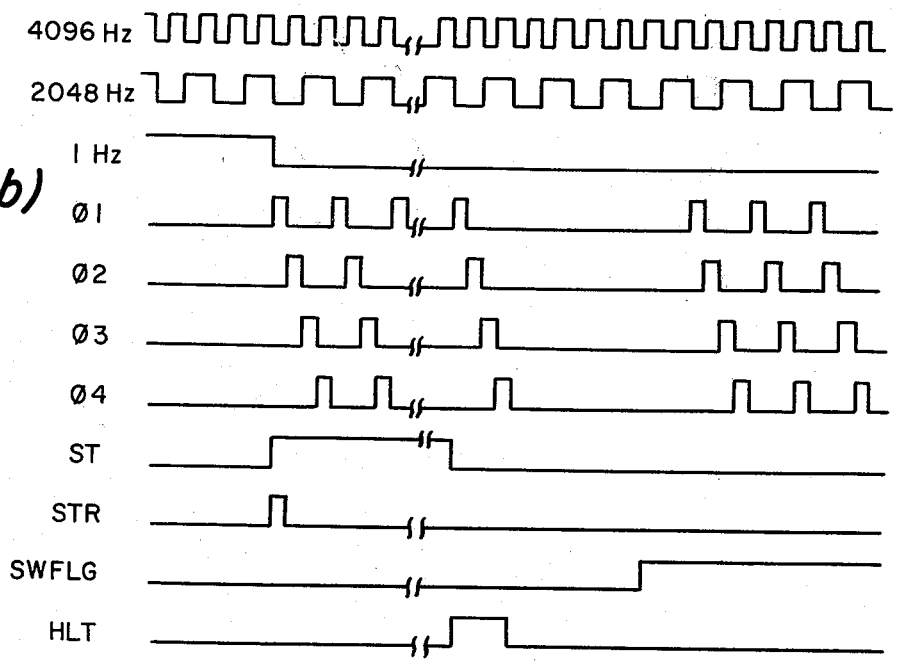

Further referring now to a detailed embodiment of each of the blocks:

FIG. 3 shows an oscillating dividing circuit, an output of a standard signal generating circuit 100 is applied to a dividing circuit 101. 4096 Hz and 2048 Hz signals of outputs of said dividing circuit 101 are applied to a timing pulse generating circuit as indicated in FIG. 4 as a clock signal, and a 1 Hz signal is applied to said timing pulse generating circuit as a time standard signal.

Figure 5:
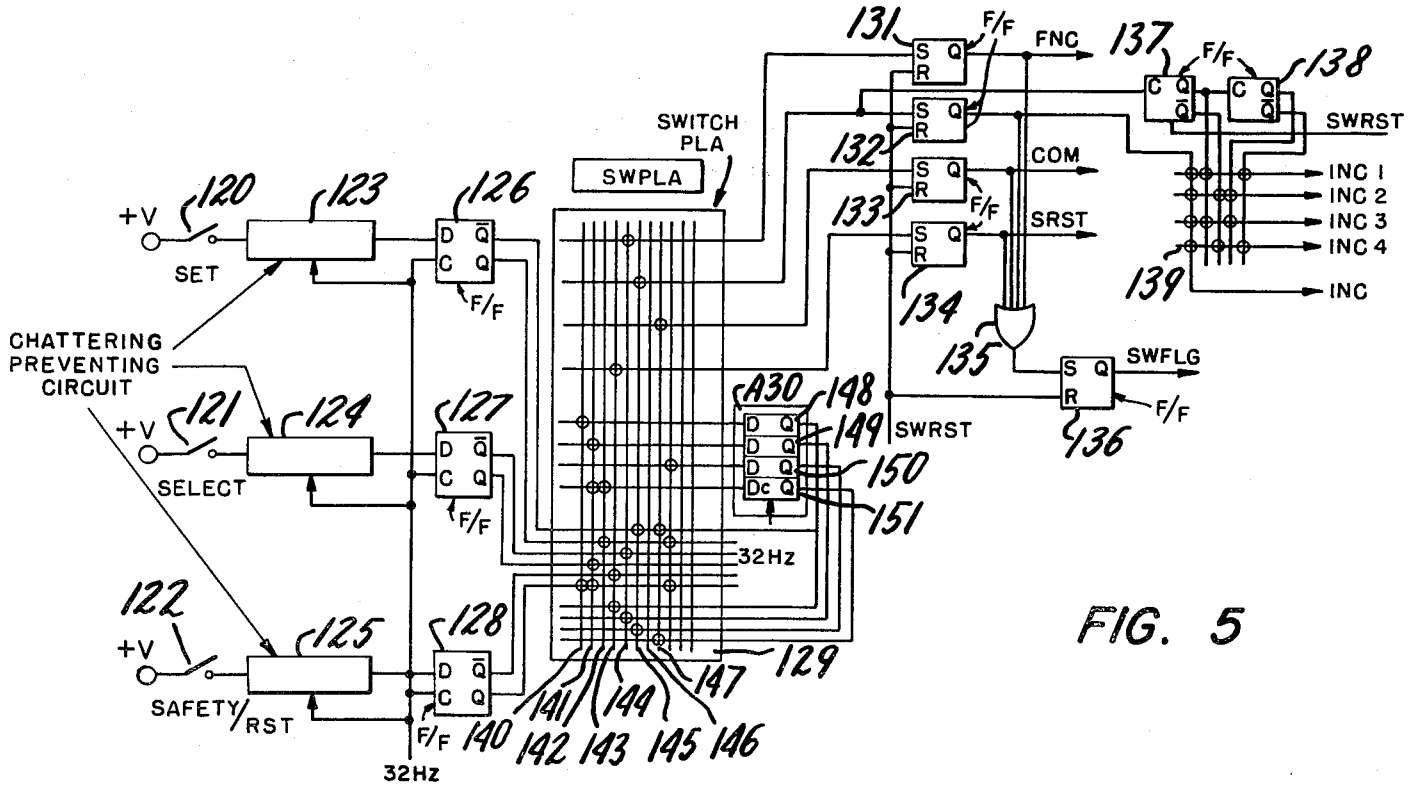
FIG. 5 shows a switching circuit construction.
Figure 6:
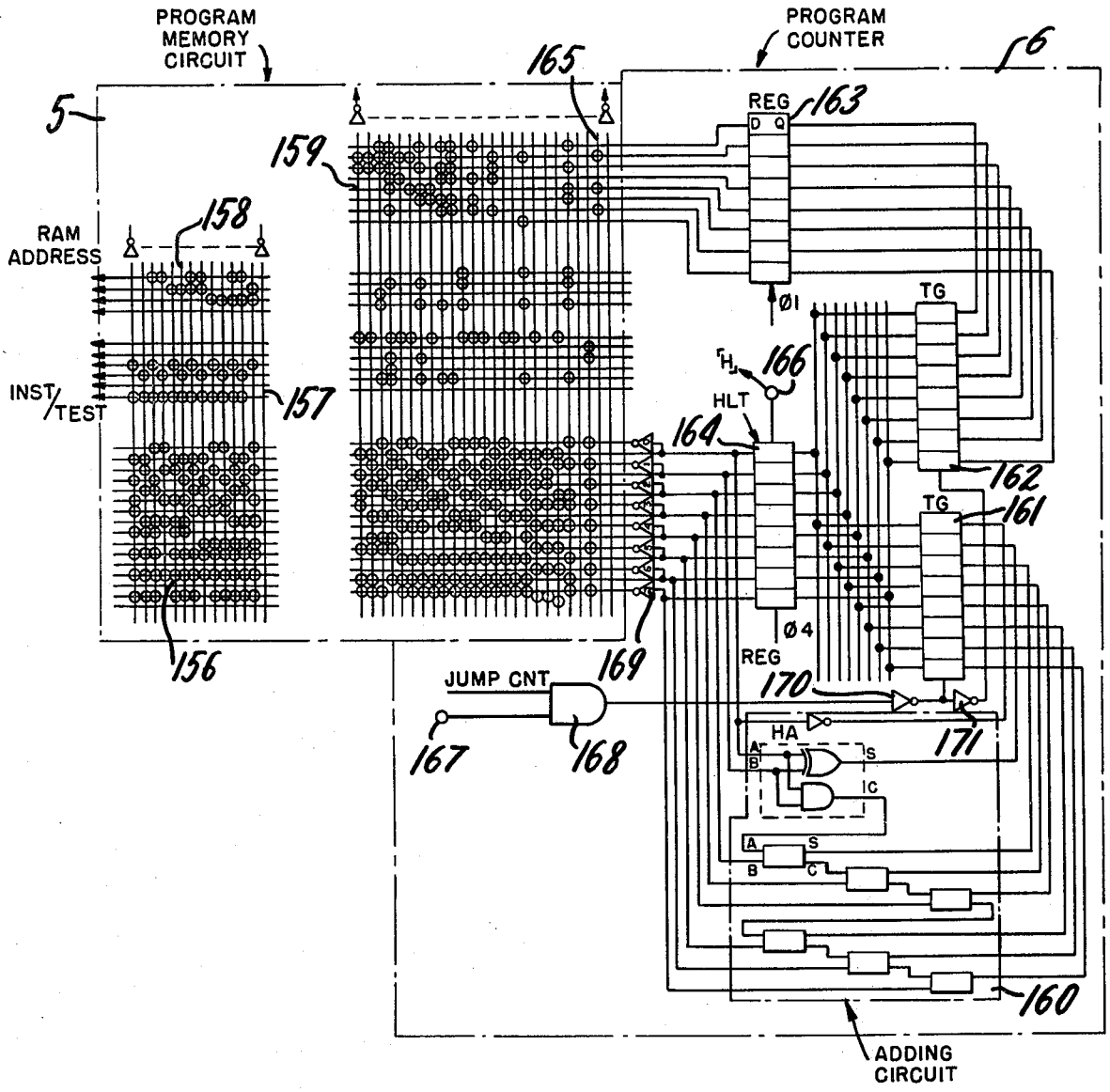
FIG. 6 shows circuit constructions of a program memory and a program counter.
Figure 7:
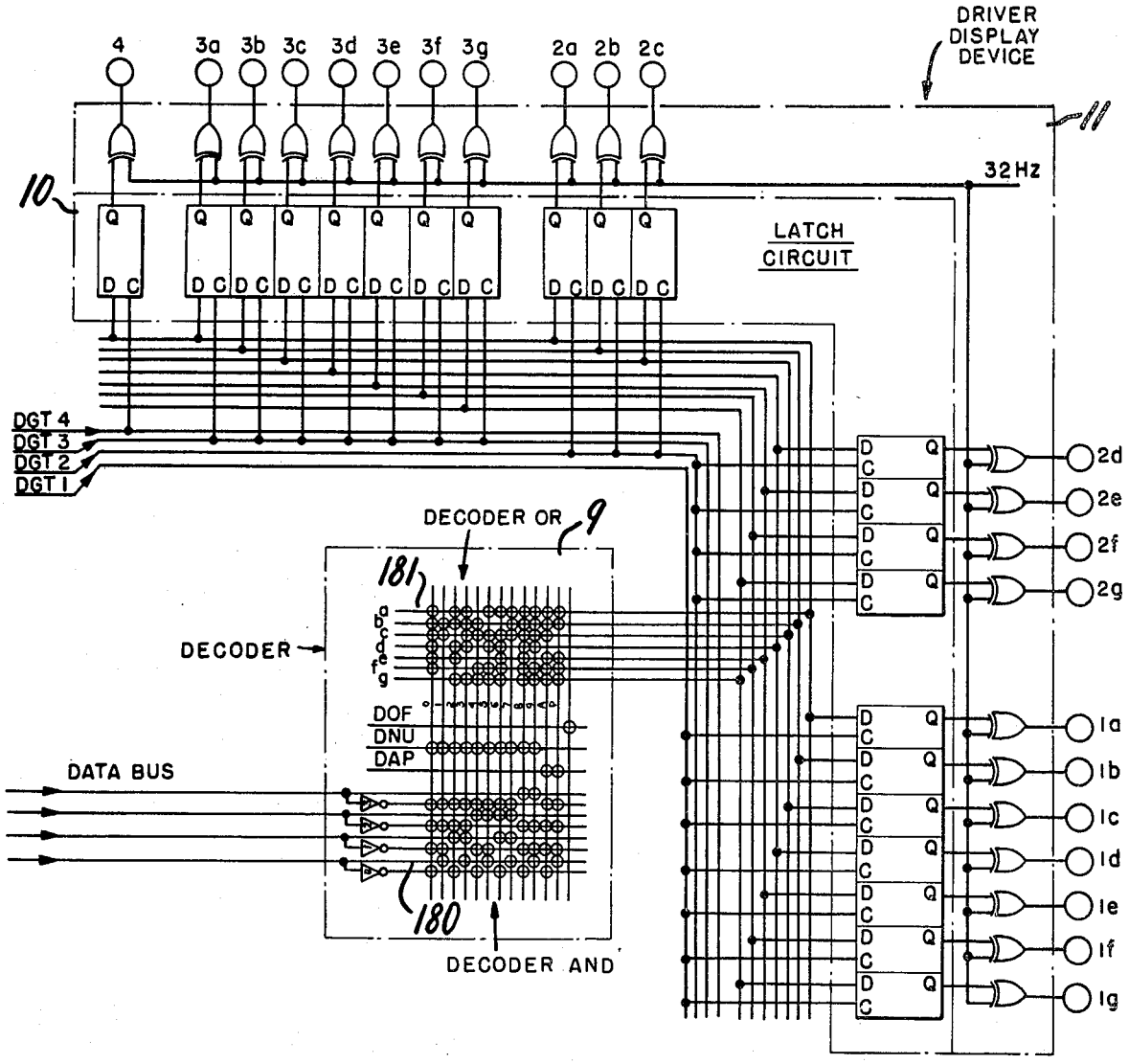
FIG. 7 shows circuit constructions of a decoder, latch and driver.
Figure 10:
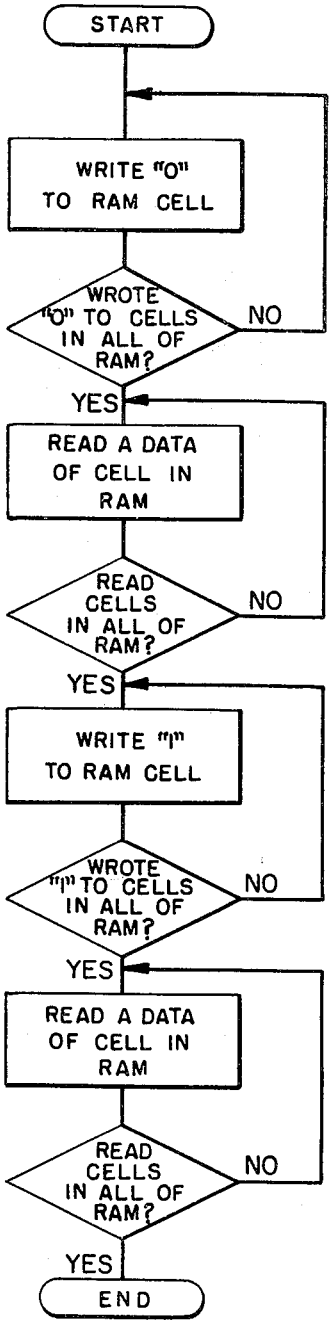
FIG. 10 shows a flow chart of a test program.

32 Hz signal of another output of said dividing circuit 101 is connected to a switch circuit in FIG. 5 and a display circuit in FIG. 10 as a clock signal of a switch and display portions.

FIG. 4 shows a timing pulse generating circuit, 4096 Hz of an output of a dividing circuit 101 is applied to a clock terminal of latch circuits 105 and 107, an inverted signal is applied to latch circuits 104 and 106 via an inverter 102.

Further, 2048 Hz of another output of a dividing circuit 101 is applied to a data terminal of said latch circuits 104 and 105, an inverted signal is applied to a data terminal of said latch circuits 106 and 107.

The data terminals of latch circuits 104–107 and the first terminal of AND gates 108–111 are respectively connected, outputs $\overline{Q}$ of said latch circuits 104–107 and second terminals of AND-gates 108–111 are respectively connected.

Further, third inputs of AND-gates 108–111 are respectively connected and are connected to an output of D-F/F117.

The outputs of AND-gates 108–111 are connected to another block as the clock signals $\phi_1$–$\phi_4$.

On the other hand, 1 Hz signal of another output of a dividing circuit 101 is connected to a data terminal of a latch circuit 112 and one input of AND-gate 113 after the phase is inverted, 4096 Hz of an output of said dividing circuit 101 is applied to a clock terminal of a latch circuit 112.

An output $\overline{Q}$ of a latch circuit 112 is connected to another input terminal of AND-gate 113, an output STP of AND-gate 113 is connected to one input terminal of OR-gate 115 and a set terminal of S-RF/F114.

HLT-signal from a control circuit is applied to a reset input terminal of said S-RF/F114, an output signal ST thereof is connected to a control circuit. A signal SWFLG from a switching circuit is applied to another input terminal of OR-gate 115, an output of said OR-gate 115 is applied to a set terminal of S-RF/F116.

HLT signal from a control circuit is connected to a reset terminal of S-RF/F116, an output Q of said S-RF/F116 is applied to a data terminal of DF/F117.

A 2048 Hz signal of an output of a dividing circuit 101 is applied to a clock terminal of DF/F117.

Referring now to an operation in the above noted timing pulse generating circuit:

When S-RF/F116 was reset, outputs $\phi_1$–$\phi_4$ of AND-gates 108–111 are "L"-level since an output Q of DF/F117 is "L"-level.

Further, $\overline{1\ Hz}$ signal is constantly delayed 120 μs by a latch circuit 112. When said $\overline{1\ Hz}$ signal is changed from "L"-level to "H"-level in the above noted condition, a standard pulse signal STP of about 120 μsec is developed an output terminal of AND gate 113.

When said STP is changed to "H"-level, S-RF/F116 is set via OR-gate whereby an output Q of DF/F117 becomes "H"-level, signals $\phi_1$–$\phi_4$ are generated since third inputs of AND-gates 108–111 become "H"-level.

Said signals $\phi_1$–$\phi_4$ are generated until a signal HLT is generated from a control circuit, said signals $\phi_1$–$\phi_4$ are stopped when said signal HLT became "H"-level and said S-RF/F116 is reset. At this time, said S-RF/F114 for generating a flag signal of STP is similarly reset. Signals $\phi_1$–$\phi_4$ are generated by a signal SWFLG which is changed to "H"-level.

Therefore, said signals $\phi_1$–$\phi_4$ are generated whenever said STP becomes "H" level once per one second or said SWFLG is changed to "H"-level by operating a switch, said signals $\phi_1$–$\phi_4$ are stopped when a signal HLT from a control circuit became "H"-level. The above noted condition is shown by a time chart of FIG. 4 (*b*).

Referring now to a switching circuit shown in FIG. 5:

One of the terminals of switches 120 and 121 are connected to a high voltage point of a power source, another of the terminals thereof are connected to chattering preventing circuits 123 to 125.

The outputs of said chattering preventing circuits 123 to 125 are applied to data terminals of DF/F 126–128, the outputs Q and $\overline{Q}$ thereof are applied to AND-section of PLA 129.

An output signal 32 Hz of a dividing circuit 101 is applied to the clock terminals of DF/F 126 to 128 and the chattering preventing circuits 123 to 125.

An output of one part of PLA 129 is connected to a data terminal of DF/F130, an output "Q" thereof is applied to AND section and is returned as another input of PLA129. A signal of 32 Hz is applied to a clock terminal of DF/F130.

Another output of PLA129 is connected to the set terminals of S-RF/F131–134, a signal "SWRST" from a control circuit 4 is applied to the reset terminals of S-RF/F131–134.

An output "Q" of S-RF/F131 is applied to a control circuit 4 as FNC signal and is connected to a first input terminal of OR-gate 135.

An output "Q" of S-RF/F132 is applied to a control circuit 4 as INC-signal and is connected to a second input terminal of OR-gate 135 and is applied to AND-PLA139.

An output "Q" of S-RF/F133 is applied to a control circuit 4 as COM signal and is connected to a third input terminal of OR-gate 135.

An output "Q" of S-RF/F134 is applied to a control circuit 4 as SRST signal and is connected to a fourth input terminal of OR-gate 135.

An output of OR-gate 135 is applied to a set terminal of S-RF/F136, a signal "SWRST" is applied to a reset terminal of S-RF/F136. Further an output "Q" is applied to a timing pulse generating circuit 2 as "SWFLG"-signal.

On the other hand, a set input of S-RF/F132 is connected to a clock input of T-F/F (Trigger flip flop) 137, Q and $\overline{Q}$ outputs thereof are applied to AND.PLA 139, and the Q output thereof is applied to a clock terminal. An output of AND.PLA is applied to a control circuit 4 as INC 1–4 signals.

Referring now to an operation of the present invention in the above noted construction:

If S-RF/F131 to 134 are reset when three switches 120 to 122 are turned OFF, all of F/F 126 to 128, 130 to 134 are completely maintained "L".

In said condition, when a switch 120 turned ON, Q output of DF/F 126 becomes "H", a column 142 of a PLA 129 is selected, a data input of DF/F150 and 151 in DF/F group 130 becomes "H", the Q output thereof becomes "H" after being delayed 1 clock period of 32 Hz whereby a column 147 of a PLA 129 is selected.

However, a column 147 is not changed to "H" during the interval $\overline{Q}$ output of DF/F126 is maintained "L".

When a switch 120 is turned OFF, Q output of DF/F147 becomes "H", S-RF/F133 is set, further COM signal becomes "H".

Further S-RF/F136 is set whereby SWFLG signal becomes "H". A set input of S-RF/F is returned to "L" since Q output of DF/F150 becomes "L" after 1 clock period.

When a switch 120 was switched in condition of a switch 122 which was maintained ON, S-RF/F132 is set by the above noted operation whereby INC signal becomes "H". A condition of TF/F137 is inverted since a set input of S-RF/F132 is connected to a clock input of TF/F137. As the result, INC-1 of AND-PLA 139 is selected whereby INC-1 becomes to "H".

Further, when a switch 120 is switched, F/F137 and 138 operates to count whereby INC-2 becomes "H". In this embodiment, the number of operations of a switch 120 is memorized until four times.

Referring now to a program memory circuit and a program counter:

Numeral 5 is ROM for a program memory, 156 is an address decoder, 157 to 159 are data circuits. Said data circuit is composed of a command 157 or a test code memory circuit, a RAM address 158 and a jumping address memory.

Numeral 6 is a program counter, 160 is an 8-bits parallel adding circuit in which eight outputs are applied to an electronic switch group 161.

An output of electronic switch group 161 is connected to an output of another electronic switch group 162 to be able to make a wired OR and is connected to a data input terminal of an address register 164.

An output of address register 164 is connected to an input of eight bits adding circuit 160, and is applied to an address decoder 156 of ROM155 via an inverter group 169.

An output of a jumping address memory 159 is connected to a data input of a jumping address register 163, an output of a register 163 is applied to an electronic switch 162.

An output of an electronic switch 162 is connected to an output of an electronic switch 161 and is applied to a register 164. Further a set terminal of a register 164 is connected to an outer terminal 166.

On the other hand, a signal "JUMPCNT" from a control circuit 4 is applied to one input of AND gate 168, an outer terminal 167 is connected to another input of said AND gate 168.

An output of AND circuit 168 is applied to a control terminal of an electronic switch 161 via an inverter 170 and is applied to a control terminal of another electronic switch 162 via an inverter 171.

Referring now to an operation in the above noted construction:

When all of the outputs of an address register 164 are "0", address "00" of ROM5 is selected whereby a data "000110" is generated from a command test code memory circuit 157, a data "0000" is generated from RAM address memory circuit 157, a data "0000" is generated from RAM address memory circuit 158, a data "01010010" namely address "52" is generated from a jumping address memory circuit 159. Whereby a discrimination "SWFLG=1" is executed, a command of address "01" is executed in case of a condition of truth, it jumps to address "52" in case of a condition of sham.

When each of the data are generated, 8-bits adding circuit 160 generates a data "01" after added "1" to address "00", further a register 163 reads a data "52" and generates.

A control circuit 4 discriminates H/L of a signal "SWFLG", and changes a signal "JUMPCNT" to "H", and changes a signal "JUMPCNT" to "L".

When a signal "JUMPCNT" is "H", an electronic switch 161 is changed to "ON" whereby information "01" is applied to a register 164 on the contrary, when a signal "JUMPCNT" is "L", an electronic switch 162 is changed to "ON" whereby output "52" of a register 163. A register 164 reads an information and executes an operation of address "01" or "52".

On the other hand, outer terminals 166 and 167 are the testing terminals, a terminal 167 is normally "H" level, a terminal 166 is normally "L" level.

A terminal 166 sets an output of a register 164 by changing a terminal to "H" level, in the present embodiment, as "AO" (10100000).

A program for a test of a data memory 8 is memorized in an address "AO". Therefore, a program is easily started from a test address by changing a terminal 166 to "H".

Further, a terminal 167 has a jumping inhibition function, a program jumping is inhibited in "L" level whereby a program is sequentially executed without a jumping from "00" to "FF".

Referring now to a decoder circuit 9, a latch circuit 10 and a drive circuit 11:

The signals DOF, DNU and DAP from a control circuit 4 and the four signals from a data bus are applied to AND-circuit 180 of a decoder 9, the segment signals a–g are generated from OR circuit 181 and are applied to a data terminal of a latch circuit 10.

An output "a" of a decoder 9 is connected to a segment drive latch "a" of the display digits, further an output "b" is connected to a segment drive latch "b".

On the other hand, the signals DGT-1 to 4 from the control circuits 4 are applied to a clock input of a latch circuit which corresponds to each of digits 1 to 4.

Further, an output "Q" of a latch circuit 10 is connected to one input of a driving EX-OR, 32 Hz from a dividing circuit 101 is connected to another input of said driving EX-OR.

Referring now to an operation of the above noted construction:

An information of 4-bits on a data bus is changed to 7-segments display signal by a decoder 9. At this time, simultaneously one of DOF, DNU and DAP signals becomes "H", a 4-bits data bus signal is changed to a segment signal for indicating numerals 6 to 9 when DNU is "H", further said 4-bits data bus signal is changed to a segment signal for indicating A or P when DAP is "H", furthermore, a to g are changed to "0" when DOF is "H".

The changed signals a to g are applied to a data terminal of a latch circuit, only a certain digit is able to read a data by changing one signal of clock signals DGT1–4 to "H".

Further a read data is memorized until a next read is executed whereby a display is statically driven.

Figure 8:
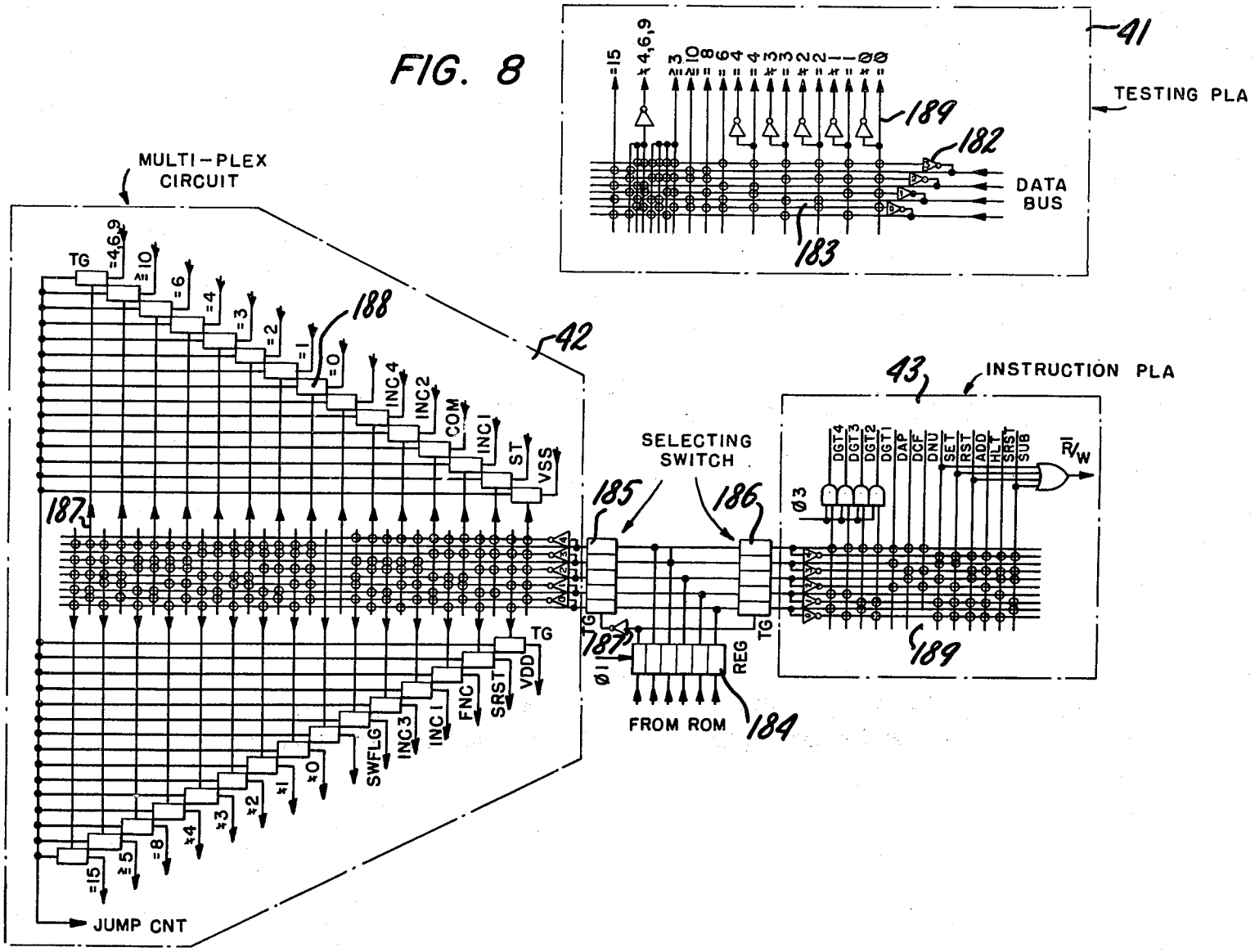
FIG. 8 shows a circuit construction of a control circuit.

Referring now to a control circuit of FIG. 8:

Numeral 41 is a test PLA, a signal of a data bus is applied to AND decoder 183, an output of said decoder 183 is applied to a data terminal of a multi-plexer 42.

On the other hand, a command discrimination data of 5-bits from ROM is applied to the selecting switches 185 and 186 via a register 184, F/I (Format Indicater) of another 1-bit is applied to a control terminal of said selecting switch 186 and is applied to a control terminal of said selecting switch 185 via an inverter 187. An output of said selecting switch 185 is applied to an address decoder of said multiplexer 42, an output of said selecting switch 186 is applied to a decoder of an instruction PLA 43.

In the above noted construction, a command condition discriminating data which was generated from a program memory 5 is read to a register 184. At this time, if a lowest bit F/I of a data is "0", said selecting switch 185 turns ON, said selecting switch 186 turns OFF, an output of a register 184 is applied to an address portion of a multiplexer 42. If an input code was "10000", an address line 187 is selected whereby a selecting switch 188 turns "ON".

A data input of said switch 188 is connected to an output 189 of a TEST PLA 41 and turns "H" only when data on a data bus is "0000".

An output of a switch 188 is maintained in a wired OR condition with another switch group and is applied to a program counter 6 as a signal "JMPCNT".

Further when F/I is "1", a selecting switch 186 turns ON, a data from ROM5 is applied to an instruction PLA 43. For instance, when a data is "01100", an output line 189 is selected whereby a command "SET" is applied to ALU7, a signal R/W (READ/WRITE) which is connected to a data RAM portion 8 turns "H".

Figure 9:
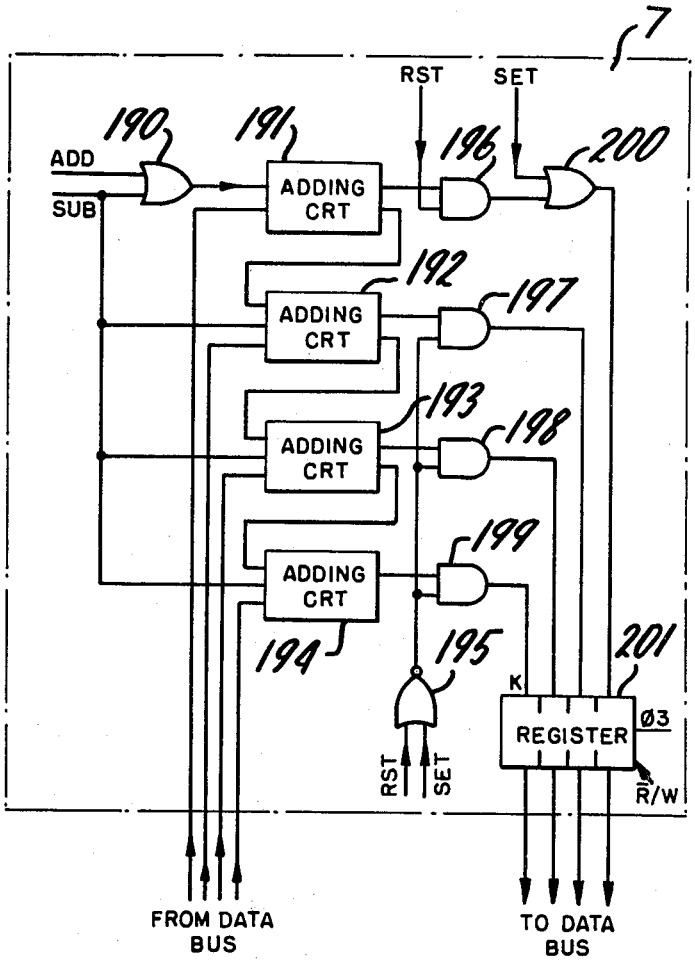
FIG. 9 shows a programming circuit construction.

Further referring now to an operation circuit 7 in FIG. 9:

Numerals 191 to 194 are adders, 191 is a half adder, 192 to 194 are full adders.

One input terminal of said half adder 191 is connected to a lowest bit of a data bus, first input terminals of said full adders 192 to 194 are connected to a signal line of 3-bits of said data bus.

The second inputs of said full adders 192 to 194 are connected to a down counting command signal "SUB" from a control portion 4, a carry output of said half adder 191 is applied to a third input of said full adder 192, a carry output of said full adder 192 is applied to a third input of said full adder 193, a carry output of said full adder 193 is applied to a third input of said full adder 194.

On the other hand, a signal "SUB" from a control circuit 4 is applied to OR-gate 190 together with a signal "ADD", further an output of said OR-gate 190 is connected to another input terminal of a half adder 191. The outputs of the adders 191 to 194 are connected to respective output terminals of AND-gates 196 to 199.

Other signals "SET and RST" from said control circuit 4 are respectively applied to NOR-gate 195, a signal "RST" is applied to one terminal of AND-gate 196, a signal "SET" is applied to one terminal of OR-gate 200.

Further an output signal of NOR-gate 195 is applied to other terminals of AND-gates 197 to 199.

An output of AND-gate 196 is connected to one input terminal of OR-gate 200, further an output of OR-gate 200 is applied to the data terminals of a register 201 in a same manner of the outputs of AND-gates 197 to 199.

A register 201 develops three state outputs, a signal $\overline{R}/\overline{W}$ from a control circuit 4 is applied to a control terminal of said register 201. Further an output of said register 201 is connected to a data bus.

In the above noted circuit construction, in case of executing an adding command, a data from RAM 8 appears on a data bus, a signal "ADD" from a control circuit 4 turns "H".

Therefore, a data of a data bus and a data "0001" according to a signal "ADD" are applied to an adding circuit, whereby data after operation in case of adding "1" to a data of the data bus is generated.

Data operated on is read to a register 201 via AND-gates 196 to 199, and is generated to a data bus when a signal $\overline{R}/W$ became to "H". At this time, signals RST, SET and SUB are "L" level.

A down counting command "SUB" is similar as the above noted condition, in this case, down counting is executed by adding "1111". Further a command "RST" is similarly all of outputs of AND-gates 196 to 199 are turned "L" level by turning a signal "RST" to "H" level without connection to a data of a data bus, and are read to said register 201.

On the other hand, a command "SET" turns the outputs of AND-gates 197 to 199 to "L" level by turning a signal "SET" to "H", a data "0001" is read to a register 201 by turning an output of OR-gate 200 to "H" level.

According to the present invention, it is able to excute a data-operation with only a program command without a transfer command by using a command construction of a composite command, whereby a symple system, a shortening of an operation time and a reduction of ROM-capacity are easily attained.

Further the above noted feature is easily obtained by employing a reset function of an operating circuit, whereby a very useful timepiece system is obtained.

We claim:

1. A circuit for an electronic timepiece comprising: a data memory circuit which stores time information and display information; operating circuit means which renews data stored in said data memory circuit; a display means having a decoder circuit, a latch circuit and a driver circuit for displaying renewed data; control circuit means for generating control signals supplied to said data memory circuit, said operating circuit and said display means; a program memory circuit which stores a sequential program of said control signals; a program counter for carrying out said program stored in said program memory circuit; a timing pulse generating circuit which supplies timing pulses to said control circuit means, said program memory circuit, said program counter, said operating circuit means, said data memory circuit and said decoder for operating each said circuit; an oscillating and dividing circuit which supplies standard pulses to said timing pulse generating circuit; and a switching circuit which is connected to switches operable for applying switching signals to operate said control circuit means.

2. A circuit for an electronic timepiece according to claim 1, wherein two command data systems are stored in the program memory circuit; one command data system consists of a controlling command which carries out time counting, time setting and/or resetting and displaying, and a command for setting and/or resetting and displaying, and a command for appointing addresses of the data memory; and the other command data system consists of commands for judging conditions, for appointing addresses of the data memory and for appointing the jumping address of the program.

3. A circuit for an electronic timepiece according to claim 2, said controlling command includes codes corresponding to set and reset the data, and having means to set or to reset the data in said operating circuit by set or reset signals from said control circuit means which are generated by said set or reset code.

* * * * *